US006141811A

United States Patent [19]

Nakamura

[11] Patent Number: 6,141,811

[45] Date of Patent: Nov. 7, 2000

[54] AUTOMATIC HAND WASHER

[76] Inventor: Eddy Nakamura, 434 St Anne's Rd., Winnipeg Manitoba, Canada, R2M 3C6

[21] Appl. No.: 09/235,193

[22] Filed: Jan. 22, 1999

[51] Int. Cl.[7] ..... A46B 13/06

[52] U.S. Cl. ..... 15/21.1

[58] Field of Search ..... 15/21.1, 33, 22.2, 15/77, 74, 88

[56] References Cited

U.S. PATENT DOCUMENTS

| | | | |
|---|---|---|---|
| 1,822,419 | 9/1931 | Rosehella | 15/33 |
| 2,248,205 | 7/1941 | Stobbe | 15/21.1 |
| 2,961,672 | 11/1960 | Alcamo | 15/21.1 |
| 3,066,336 | 12/1962 | Stobbe | 15/21.1 |
| 3,332,099 | 7/1967 | Reiter | 15/21.1 |
| 3,439,370 | 4/1969 | McLaughlin | 15/21.1 |
| 3,691,577 | 9/1972 | Bliss | 15/21.1 |
| 4,280,672 | 7/1981 | Sontos et al. | 15/88 |
| 5,611,099 | 3/1997 | Kelly | 15/21.1 |

FOREIGN PATENT DOCUMENTS

| | | | |
|---|---|---|---|
| 716871 | 2/1942 | Germany | 15/74 |

*Primary Examiner*—Gary K. Graham

[57] ABSTRACT

An automatic hand washer apparatus comprised of a housing capable of holding a supply of cleaning fluid. A pair of hand access openings are provided in the housing to receive hands and arms to be cleaned. The openings define axes along which the arms and hands can be inserted into the housing. A pair of opposed horizontal brushes are provided adjacent to the openings and are mounted for reciprocal movement such that they move perpendicular to the opening axes.

3 Claims, 1 Drawing Sheet

AUTOMATIC HAND WASHER

BACKGROUND OF THE INVENTION

The present invention relates to motorized washing machines that will scrub the dirt and grease which may accumulate on a person's hands at their workplace.

In prior art, previous hand cleaning machines such as U.S. Pat. No. 3,066,336 used brushes that reciprocated parallel to the axis of the arm and had a circular opening in the brushes in which to insert your hand. The obvious problem with this design was that the circular opening in the brushes must fit your hand closely or your hand would not be cleaned completely or if your hand was large, it may not fit into the circular opening. Reciprocating the two brushes perpendicular to the axis of the arms solves these problems.

SUMMARY OF THE INVENTION

In view of the foregoing disadvantages inherent in the known types of hand washing devices, the present invention provides an improved hand and arm cleaning device. To attain this, the present invention reciprocates two brushes perpendicular to the axis of the arms. The bristle tips of the lower brush would be in contact with the bristle tips of the upper brush while they are reciprocating which would make them self cleaning. With no circular opening, the long flexible bristles would accommodate any size hand whether large or small and the cleaning action could be concentrated to areas which needed it the most. Also, any injured areas could be avoided. Reciprocating the brushes perpendicular to the arm axis also allows the use of a secondary brush with short bristles designed to clean under the fingernails. This is the only machine with this feature. A pump shall spray cleaning solution of hot soapy water onto the person's hands while the brushes are moving. The cleaning water shall be recycled until it is too dirty for reuse and shall be flushed away by pulling a lever. A float valve mechanism will fill the inside of the machine with clean fluid and shut off after it has refilled to the correct amount. The float valve to the wash water shall automatically dispense a liquid antibacterial soap. A thermostatically controlled heater shall warm the water to increase the cleaning action.

The unit should pay for itself in time because the cleaning solution is reused several times before being discarded. Also, this unit uses a cheaper soap rather than the more expensive hand cleaner compound which is used extensively in more traditional hand cleaning methods. Cleaning dirty sinks should be a thing of the past since this unit contains the mess within itself and is self-cleaning.

DESCRIPTION OF THE PREFERRED EMBODIMENT

With reference now to the drawings, the new and improved automatic hand washer will be described.

Figure 1:
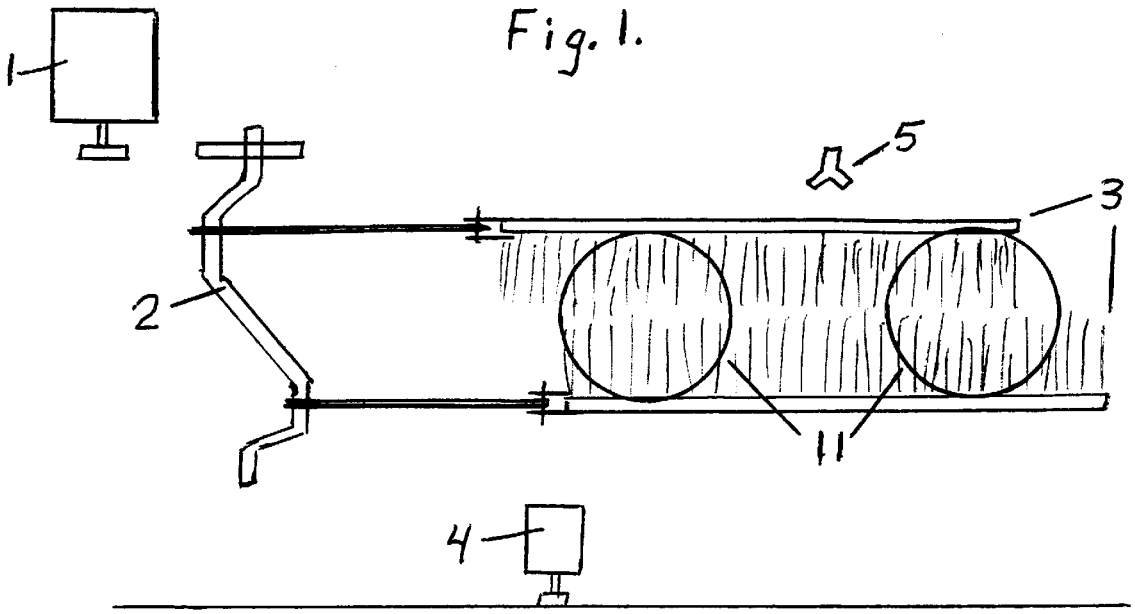
FIG. 1 is a front view of the brushes and shows the drive mechanism coupled therewith.

In the drawings, FIG. 1 shows the machine from the front depicting the horizontally reciprocating scrubbing brushes

Figure 2:
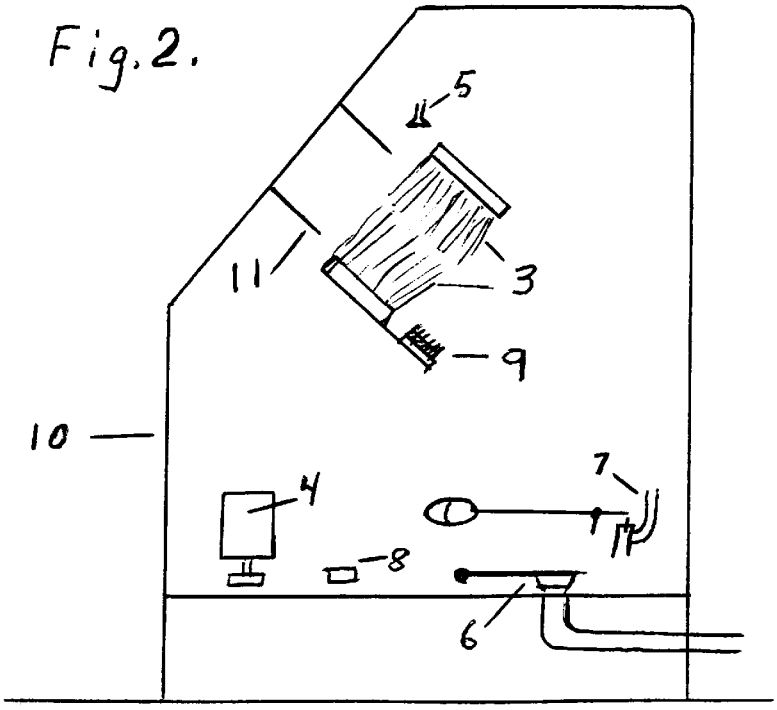
FIG. 2 is a side view of the housing showing the layout of the various components therein.

(3) and the location of the round access openings (11) through which the hands and arms are inserted and guided in between the brushes. Also depicted is the crank mechanism (2) and driving motor (1). Located above the scrubbing brushes is a spray nozzle (5) for dispersing soapy water from an electric water pump (4) to the brush scrubbing area. FIG. 2 shows the machine from a side view illustrating the housing (10), the reciprocating scrubbing brushes located adjacent to the hand access openings which are positioned in the upper part of the machine. These access openings and brushes have a unique downward slant to keep cleaning fluids draining into the machine interior. Attached to the lower edge of the bottom scrubbing brush is a short bristle brush (9) for providing an aggressive cleaning action for the fingernails. Illustrated in the bottom of the housing is a flapper valve (6) for disposing dirty cleaning fluids to the sewer, a float valve mechanism (7) for refilling the machine, a thermostatically controlled heater for heating the fluids and an electric pump for spraying cleaning fluids to the scrubbing brush area from the spray nozzle.

In detail, the rotating crankshaft (2) shown in FIG. 1 will produce a scrubbing action by the brushes (3) onto hands and arms inserted therebetween. The pump motor (4) will spray hot soapy water onto both hands and brushes (3) from the spray nozzle (5). Simply inserting both hands in between the brushes (3) to clean the area desired and withdrawing them should produce excellent results. The wash water will be continuously recycled until it is too dirty for reuse and then disposed of into the sewer by opening the flapper valve (6) as shown in FIG. 2. The float valve (7) will open and spray clean water into the machine interior and shut off after the machine has refilled. A thermostatically controlled heater (8) will warm the wash water to increase the cleaning action.

What is claimed is:

1. A motorized arm and hand washing machine, said machine comprising;

a housing having a front and back and defining a washing chamber therein, said housing capable of holding a supply of water in a bottom thereof to aid in the washing of the hands and arms, said housing also having two arm and hand access openings in a wall of said front, each opening defining an entry axis along which the arms and hands to be washed can enter the chamber, a pair of cleaning brushes, each cleaning brush being elongated to define a longitudinal axis, said brushes horizontally disposed opposing one another in the chamber adjacent the access openings and extending perpendicular to said entry axes, each brush includes bristles having a length of between 1 and 6 inches, bristle tips of the opposing brushes engage with one another, a brush drive mechanism connected with both brushes, said drive mechanism alternatively reciprocates said brushes along their respective longitudinal axes out of phase with one another, driving means to drive the brush drive mechanism, float valve provided in said housing and coupled with a water supply to regulate water level within said chamber, an electric heater provided in said housing and located to be submerged in the wash water for heating said wash water, a water pump provided in said housing and located to be submerged in the wash water, a spray nozzle mounted in said housing and located to spray wash water onto the brushes, arms and hands, said pump fluidly coupled with said nozzle, a flapper valve in said bottom of said housing, said flapper valve adapted to drain water from the housing when it becomes dirty.

2. The motorized hand and arm washing machine of claim 1 wherein the drive mechanism is a crank mechanism.

3. The motorized hand and arm washing machine of claim 1 wherein the driving mean is a motor.

* * * * *